US006383030B1

(12) United States Patent
Ichikawa et al.

(10) Patent No.: US 6,383,030 B1
(45) Date of Patent: May 7, 2002

(54) ELECTRICAL CONNECTOR

(75) Inventors: Kazunori Ichikawa; Naofumi Miyazaki, both of Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 09/929,105

(22) Filed: Aug. 15, 2001

(30) Foreign Application Priority Data

Aug. 15, 2000 (JP) ..... 2000-246425

(51) Int. Cl.[7] ..... H01R 13/64
(52) U.S. Cl. ..... 439/677; 439/680
(58) Field of Search ..... 439/677, 680, 439/607

(56) References Cited

U.S. PATENT DOCUMENTS 4,913,665 A * 4/1990 Sacksen ..... 439/677
5,613,882 A * 3/1997 Hnatuck et al. ..... 439/686
5,993,258 A * 11/1999 Matsunuma et al. ..... 439/607
6,007,382 A * 12/1999 Wu ..... 439/607
6,059,581 A * 5/2000 Wu ..... 439/79
6,139,350 A * 10/2000 Mathesius ..... 439/357

* cited by examiner

*Primary Examiner*—Tulsidas Patel
(74) *Attorney, Agent, or Firm*—Kanesaka & Takeuchi

(57) ABSTRACT

An electrical connector comprises a plugging projection (12) to be plugged into the plugging cavity (24) of a mating connector (20) and a pair of projections (15) provided on one of major faces of the plugging projection (12) so as to enter the corresponding grooves (28) of the mating connector (20) in the regular plugging direction.

1 Claim, 5 Drawing Sheets

ELECTRICAL CONNECTOR

BACKGROUND OF THE INVENTION

1. Field of the Invention

The present invention relates to electrical connectors and, particularly, to an electrical connector capable of preventing tilted plugging.

2. Description of the Related Art

Most of multiple pole connectors having a large number of terminals have a plugging section with an elongated rectangular plugging face. For example, they have a rectangular plugging cavity for receiving a mating connector that has a rectangular plugging projection.

An example of such electrical connectors is disclosed by Japanese patent application No. 10-199626. This connector comprises a housing with an arranging plate having a face on which the contact sections of a plurality of terminals are arranged and a shield case spaced from the arranging plate so as to define a plugging cavity for receiving the plugging projection of a mating connector. A plurality of slots are provided in the plugging projection for supporting the contact sections of terminals.

Upon plugging, the arranging plate enters the slots, bringing the contact sections of terminals of both the connectors into contact with each other for electrical connection. This connector has no problem where both the connectors are plugged in the regular direction.

However, when the front edges of the plugging cavity and projection are at an angle upon plugging, part of the plugging projection abuts on the front end of the arranging plate within the plugging cavity, damaging the arranging plate. The arranging plate is made of the same material as the housing and is so thin that it is damaged by repeated strong impacts.

A key and a key slot are provided to prevent upside down plugging. However, the key and key slot are provided in the middle of the connectors so that they are not helpful for preventing the damage caused by such tilted plugging as described above.

SUMMARY OF THE INVENTION

Accordingly, it is an object of the invention to provide an electrical connector capable of preventing the tilted plugging, thus providing a protection upon handling the connector.

According to one aspect of the invention there is provided an electrical connector which comprises a substantially rectangular plugging projection to be plugged into a plugging cavity of a mating connector; a pair of projections or ridges provided on at least one of major faces of said plugging projection near opposite side edges of said major face so as to enter corresponding grooves of said mating connector in a regular plugging direction.

In the tilted plugging, a corner of the plugging projection tries to enter the plugging cavity of a mating connector. However, the projection provided on the front edge prevent such entrance. In the regular plugging direction, however, the projections enter the corresponding grooves of the mating connector to complete the plugging. The projections may be ridges to stabilize the guidance by the grooves.

The projections are provided on both major faces of said plugging projection and said projections on one of said major faces have a width and a distance therebetween that are different from those of said faces on the other major face to prevent not only tilted plugging but also upside down plugging.

According to another aspect of the invention there is provided an electrical connector comprising a plugging cavity defined by a rectangular tubular wall; a pair of grooves extending in a plugging direction in at least one of major faces of said tubular wall near opposite side edges so as to receive a corresponding projections of a mating connector in a regular plugging direction.

The grooves guide the projections of the other connector in the regular plugging direction. The grooves are provided in either the tubular wall of the housing or a shield case over the housing. The grooves may be recess that open toward only inside or slits that open through the tubular wall. In the case of the shield case, the grooves are slits that open through the sheet metal.

It is preferred that said shield case has tapered front edges that terminate front ends of said slits, making a continuous front circumference to maintain the strength of the shield case.

DESCRIPTION OF THE PREFERRED EMBODIMENT

Figure 1A:
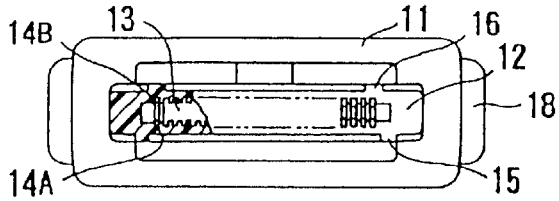
FIG. 1A is a front view of one of a pair of connectors.
Figure 1B:
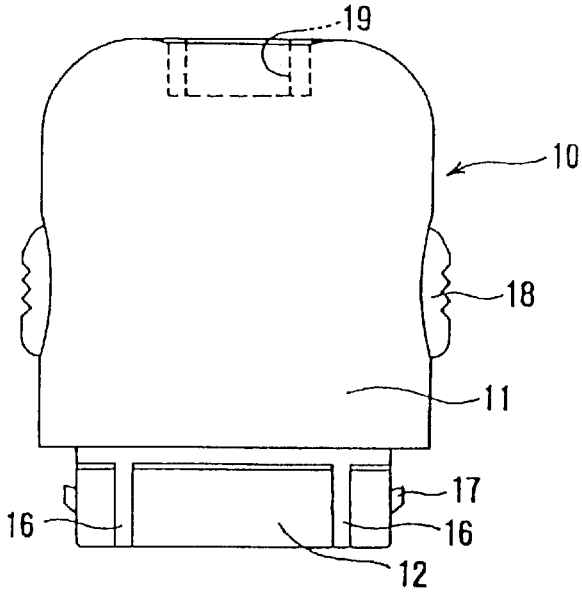
FIG. 1B is a top view of the connector.
Figure 1C:
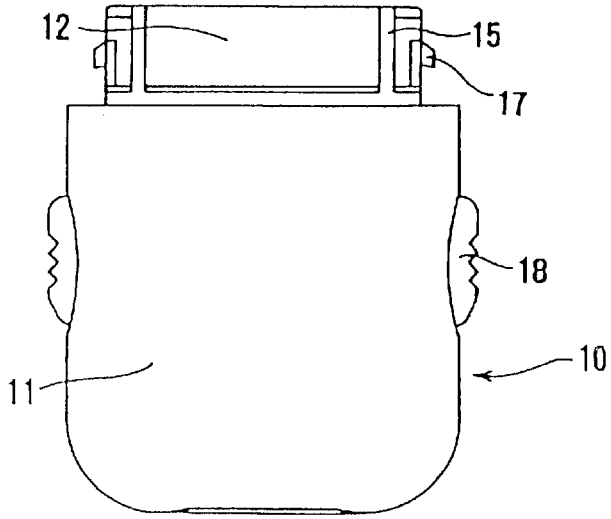
FIG. 1C is a bottom of the connector.
Figure 1D:
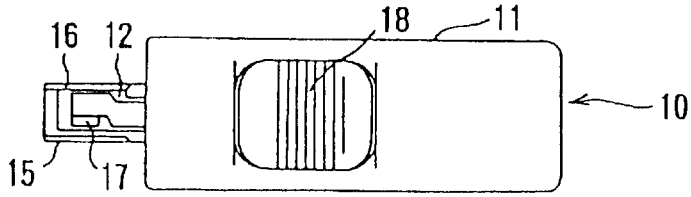
FIG. 1D is a side view of the connector.
Figure 2:
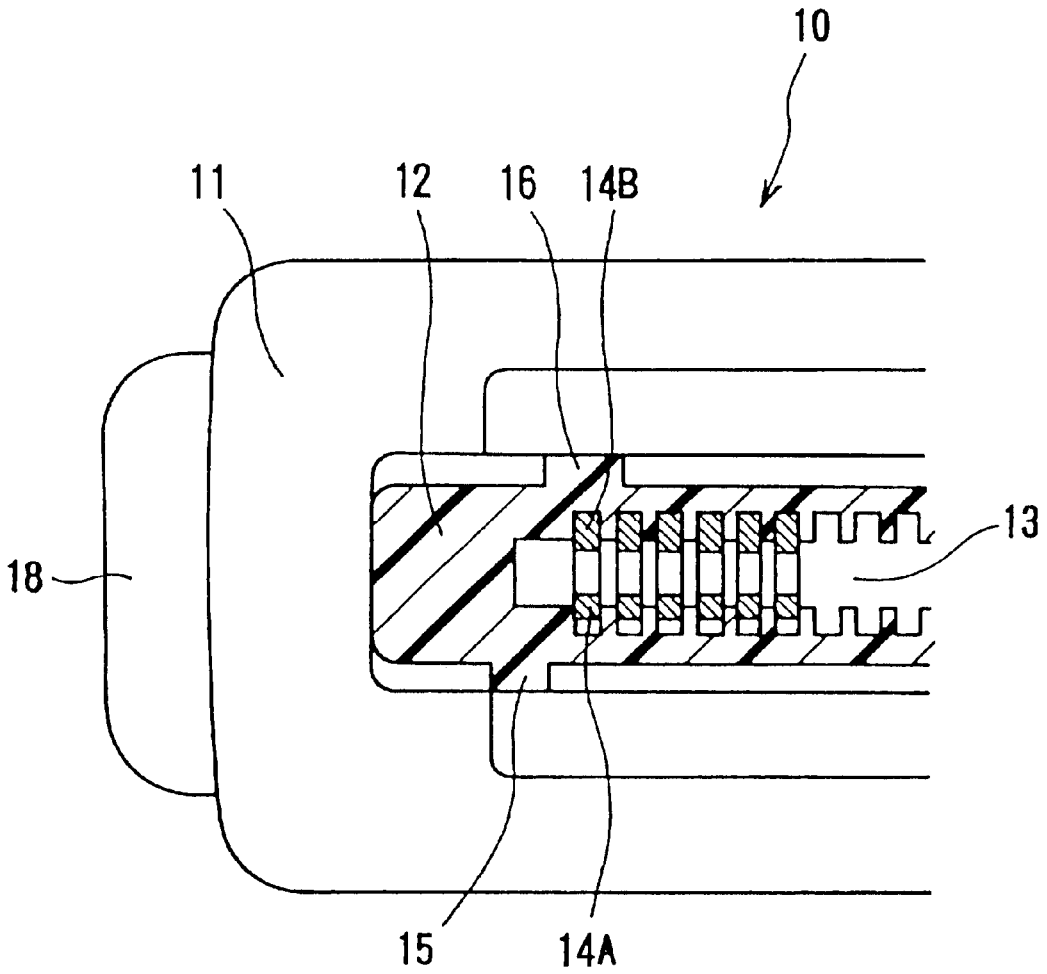
FIG. 2 is an enlarged front view of part of the connector.
Figure 3A:
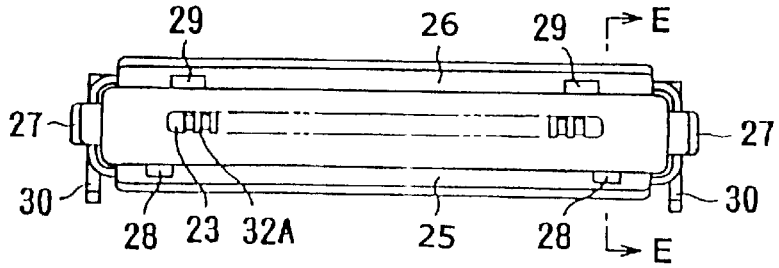
FIG. 3A is a front view of the other connector.
Figure 3B:
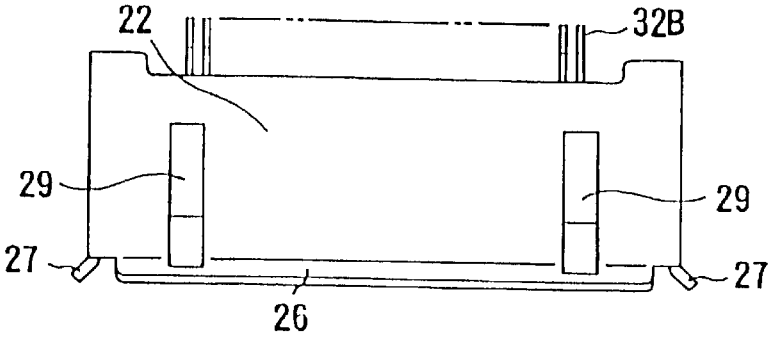
FIG. 3B is a top view of the other connector.
Figure 3C:
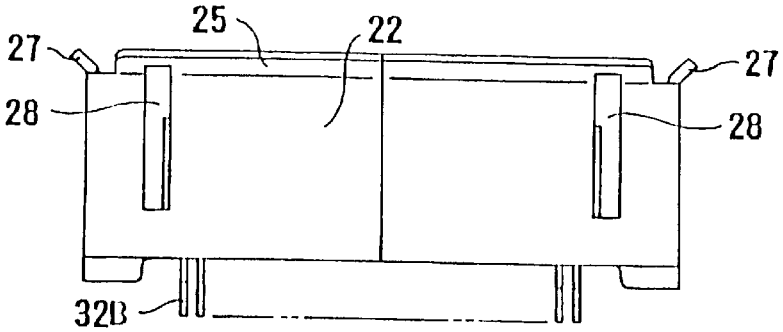
FIG. 3C is a bottom view of the other connector.
Figure 3D:
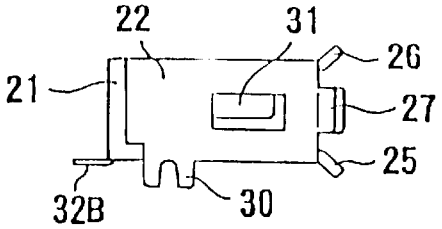
FIG. 3D is a side view of the other connector.
Figure 3E:
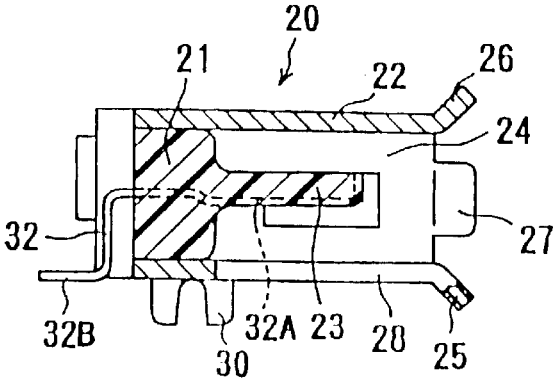
FIG. 3E is an enlarged sectional view taken along line E—E of FIG. 3A.
Figure 4:
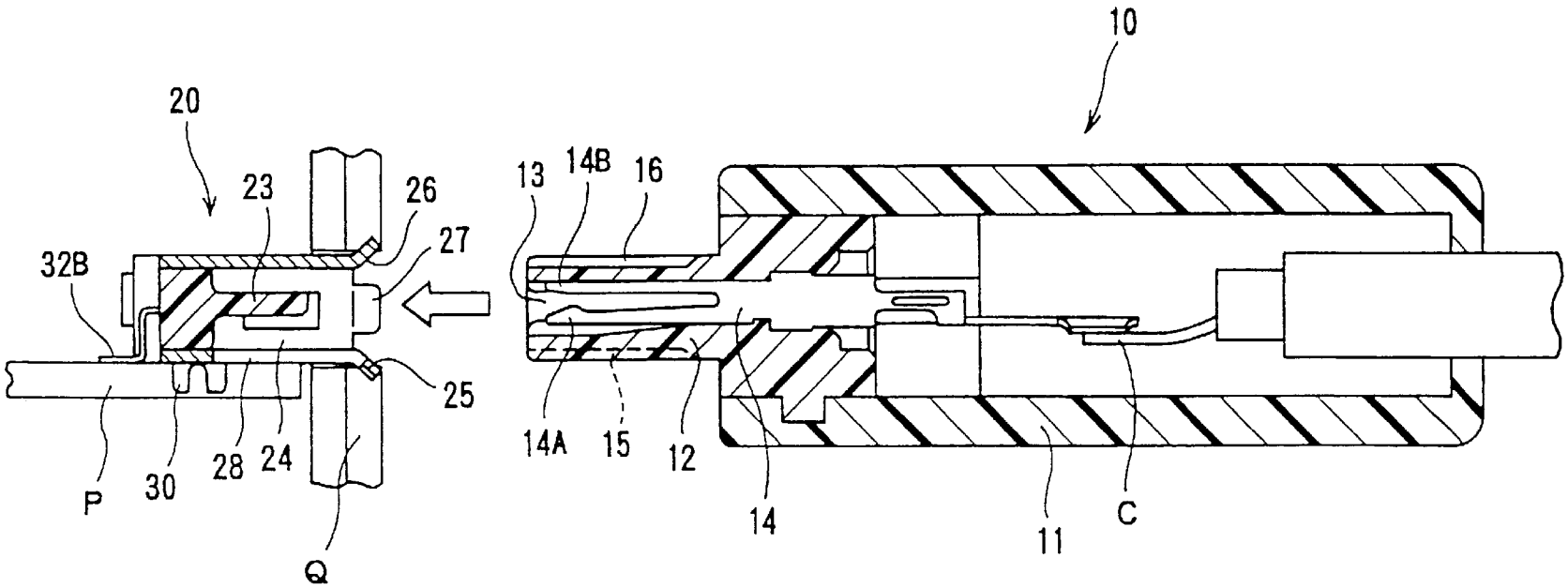
FIG. 4 is a sectional view of the connectors prior to plugging in the regular direction.

In FIGS. 1 and 2, a connector 10 comprises a housing body 11 and a plugging projection 12 extending forward from the housing body 11. The plugging projection 12 is made of the same insulative material as the housing body 11 so as to provide a slot-equipped rectangular cavity 13 defined by rectangular walls, in the upper and lower walls of which a plurality of terminal slots are provided. The plugging projection 12 is joined with the housing body 11 as shown in FIG. 4. Alternatively, it may be integrally molded with the housing body as a unit.

The contact sections 14A and arm sections 14B of a plurality of terminals 14 are arranged in the slot-equipped cavity 13. They are made by bifurcating the front portion of a terminal 14 so that the arm section 14B support the terminal of a mating connector, bringing the contact section 14A into spring contact with the terminal.

A pair of first ridges or projections 15 are provided on a one of the major rectangular walls of the plugging projection 12 near opposite side edges. A pair of second ridges 16 are provided on the other major wall within the distance between the first ridges 15 to prevent wrong plugging. The second ridges 16 is made different from the first ridges 15 in terms of not only the ridge distance but also the width of a ridge so as to prevent not only upside down plugging but also plugging of a connector that has a different ridge distance.

A pair of lock wings 17 project from the opposite sides of the plugging projection 12. A pair of operational knobs 18 are squeezed to retract the lock wings 17. The lock wings 17 engage the mating connector to prevent separation but they are not involved with the invention and, therefore, the further description will be omitted. A through-hole 19 is provided at the rear end of the housing body 11 to permit a cable to pass to the connector terminal.

In FIG. 3, the other connector 20 comprises a housing body 21 and a shield case 22 to cover the housing body 21. The housing body 21 has an arranging plate 23 on which the contact sections of terminals are arranged. The arranging plate is made so as to fit into the slot-equipped cavity 13 of the connector 10. The shield case 22 has a substantially rectangular tubular form and is attached to the rear portion of the housing body 21 so as to be spaced from the arranging plate 23 to form a plugging cavity 24, into which the plugging projection 12 of the connector 10 is fitted.

The front edge of the shield case 22 has tapered portions 25, 26, and 27 to guide insertion of the connector 10. A plurality of slits 28 and 29 extend forwardly up to the tapered portions 25 and 26 to receive the ridges 15 and 16 of the connector 10, respectively. That is, the slits 28 and 29 are closed at the tapered portions 25 and 26 to maintain the strength of the shield case. A plurality of leg portions 30 extend downwardly from the shield case 22. They are inserted into corresponding holes of a circuit board and soldered to corresponding circuit traces for electrical connection and mechanical fixation. A pair of engaging windows 31 are provided in the side walls of the shield case 22 for engagement with the lock wings 17 of the connector 10 when the plugging projection 12 reaches a predetermined position. Each terminal 32 of the connector 20 has a contact section 32A arranged on the arranging plate 23 and a connection section 32B projecting from the rear end of the housing body 21.

The connector 10 is plugged into the connector 20 as shown in FIG. 4. First of all, a core wire C of a cable is soldered to the rear portion of a terminal 14 of the connector 10. All the core wires are connected to the remaining terminals, the member of the plugging projection 12 is fitted into the housing body 11. The other connector 20 is attached to a circuit board P and the connection sections 32B of the terminals 32 and the leg portions 30 of the shield case 22 are soldered to the corresponding circuit traces. The circuit board P is installed in the equipment such that the connector 20 is provided at the opening of the case or panel Q. As shown in the figure, the height of tapered portion 26 of the shield case 22 is within the thickness of the circuit board P so that the effective height of the connector is not increased by the tapered portion.

In use, the plugging projection 12 of the connector 10 is plugged into the plugging cavity 24 of the connector 20 so that the arranging plate 23 of the connector 20 is fitted in a space between the contact sections 14A and the arm sections 14B of the terminals 14 of the connector 10, bringing the contact sections 32A of the terminals 32 into spring contact with the contact sections 14A of the terminals 14 for electrical connection. The ridges 15 and 16 of the connector 10 are guided by the grooves 28 and 29 of the connector 20, respectively. The height of the ridges 15 and 16 are made smaller than the height of the grooves 28 and 29 or the thickness of the shield case 22 so that the ridges do not project from the connector 20, preventing an increase in the height of the connector.

Figure 5:
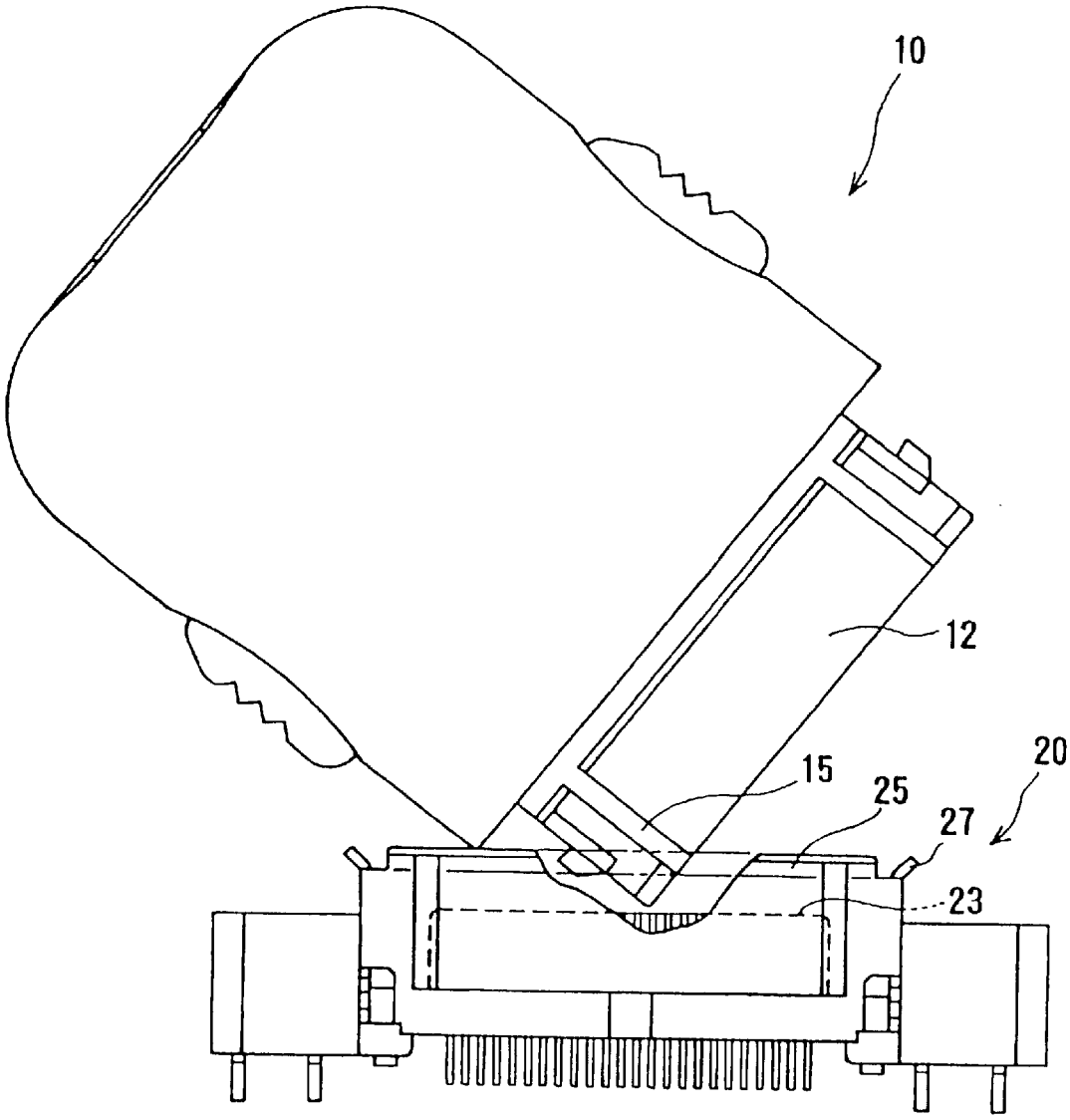
FIG. 5 is a diagram showing an attempt of tilting plugging.

As shown in FIG. 5, if an attempt is made to plug the connector 10 into the connector 20 at an angle, the ridge 15 of the plugging projection 12 abuts against the front edge of the plugging cavity 24 of the connector 20, preventing the plugging and the plugging projection 12 from hitting the arranging plate 23, causing damage to it. In this way, the tilted plugging is prevented. The ridges 16 provided on the face opposite to the face on which the ridges 15 are provided are located at widthwise positions different from those of the ridges 15 so as to prevent plugging of a different type of connector or the same type of connector upside down.

A number of modifications may be made to the above embodiment. For example, the ridges may be provided at the same position on both the sides of the plugging projection. The grooves or slits for receiving the ridges or projection, which were provided in the shield case, may be provided in the inside of a circumferential wall that is made of the same material as the housing so as to surround the arranging plate.

According to the invention, a plurality of ridges and grooves are provided on the plugging projection and cavity, respectively, so that if tilting plugging is attempted, the plugging projection is prevented from entering the plugging cavity to avoid any damage to the arranging plate, etc. within the plugging cavity.

What is claimed is:

1. An electrical connector assembly including a plug and receptacle connectors, said plug connector comprising:

a housing body;

a substantially rectangular plugging projection extending forwardly from said housing body;

a slot-equipped rectangular cavity provided in said plugging projection;

a plurality of first terminals arranged in said slot-equipped cavity;

a first pair of projections provided on one major rectangular face of said plugging projection and extending rearwardly from front edge of said plugging projection; and a second pair of projections provided on the other major rectangular face of said plugging projection and extending rearwardly from said front edge of said plugging projection, said second pair of projections having a width and a distance therebetween that are different from those of said first pair of projections, said receptacle connector comprising:

a housing body;

a substantially rectangular shield case having tapered front edges for guiding said projections of said plug connector;

a plugging cavity defined by said shield case and receiving said plugging projections of said plug connector;

an arranging plate provided in said plugging cavity and plugged into said slot-equipped cavity of said plugging projection of said plug connector;

a plurality of second terminals provided in said arranging plate;

a first pair of slits provided on one major face of said shield case and extending rearwardly from one major edge of said tapered front edges so as to receive said first pair of projections of said plug connector in a regular plugging direction; and a second pair of slits provided on the other major face of said shield case and extending rearwardly from the other major edge of said tapered front edges so as to receive said second pair of projections of said plug connector in said regular plugging direction, wherein heights of said first and second projections of said plug connector are made smaller that a thickness of said shield case of said receptacle connector, and a height of said receptacle connector is substantially equal to a height between said first nd second projections of said plug connector.

* * * * *